US006360770B1

(12) United States Patent
Buchner et al.

(10) Patent No.: US 6,360,770 B1
(45) Date of Patent: Mar. 26, 2002

(54) MODULAR LAVATORY FAUCET SPOUT MOUNTING

(75) Inventors: Daniel C. Buchner, Amherst; John H. Daniel, III, Strongsville; Todd C. Loschelder, Macedonia; Allen L. Talley, Hudson; Timothy J. O'Brien, Bay Village; William R. Markowitz, Cleveland, all of OH (US); Erwin F. Mikol, The Villages, FL (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/576,292

(22) Filed: May 23, 2000

(51) Int. Cl.[7] ..... F16K 43/00; E03C 1/04

(52) U.S. Cl. ..... 137/315.12; 29/221.6; 4/678; 4/695; 137/315.41; 137/359; 137/360; 137/801

(58) Field of Search ..... 4/675, 676, 678, 4/695; 137/315.12, 315.41, 359, 360, 606, 801; 29/213.1, 221.6

(56) References Cited

U.S. PATENT DOCUMENTS

| | | | | | |
|---|---|---|---|---|---|
| 4,026,328 | A | * | 5/1977 | Nelson | 137/801 |
| 4,387,738 | A | | 6/1983 | Bisonaya et al. | 137/801 |
| 4,635,673 | A | | 1/1987 | Gerdes | 137/801 |
| 4,852,192 | A | | 8/1989 | Viegener | 4/678 |
| 4,998,555 | A | | 3/1991 | Barhydt, Sr. et al. | 137/359 |
| 5,010,922 | A | | 4/1991 | Agresta | 137/359 |
| 5,073,991 | A | * | 12/1991 | Marty | 4/678 |
| 5,131,428 | A | | 7/1992 | Bory | 137/606 |
| 5,165,121 | A | | 11/1992 | McTargett et al. | 137/801 |
| 5,224,509 | A | | 7/1993 | Tanaka et al. | 137/801 |
| 5,232,008 | A | | 8/1993 | Jeffress et al. | 137/801 |
| 5,381,830 | A | | 1/1995 | Niemann et al. | 137/801 |
| 5,388,287 | A | | 2/1995 | Tischler et al. | 4/678 |
| 5,458,154 | A | | 10/1995 | Niemann et al. | 137/801 |
| 5,464,045 | A | | 11/1995 | Niemann et al. | 137/801 |
| 5,465,749 | A | | 11/1995 | Sauter et al. | 137/801 |
| 5,515,882 | A | | 5/1996 | Hennis | 4/678 |
| 5,558,128 | A | | 9/1996 | Pawelzik et al. | 137/801 |
| 5,642,755 | A | | 7/1997 | Mark et al. | 137/801 |
| 5,669,417 | A | | 9/1997 | Lian-Jie | 137/801 |
| 5,685,341 | A | | 11/1997 | Chrysler et al. | 137/801 |
| 5,746,244 | A | | 5/1998 | Woolley, Sr. et al. | 137/801 |
| 5,797,151 | A | | 8/1998 | Ko | 137/801 |
| 5,803,120 | A | | 9/1998 | Bertoli | 137/801 |
| 5,924,451 | A | * | 7/1999 | Kuo | 137/801 |
| 5,946,746 | A | * | 9/1999 | Bloom | 4/675 |
| 6,085,784 | A | * | 7/2000 | Bloom et al. | 137/801 |
| 6,138,296 | A | * | 10/2000 | Baker | 4/678 |

* cited by examiner

*Primary Examiner*—George L. Walton
(74) *Attorney, Agent, or Firm*—Cook, Alex, McFarrron, Manzo, Cummings & Mehler, Ltd.

(57) ABSTRACT

A faucet spout fixture provides for spout mounting and removal from above a supporting surface such as a sink deck, without disconnection of the water supply conduits beneath the sink deck. The fixture includes a faucet spout which has a water passage and a water discharge in communication with the passage. There is a water inlet in the spout which communicates with the passage. A water supply assembly is located beneath the supporting surface and there is a spout waterway adjustably connected to the water supply assembly, which spout waterway extends into the spout water inlet. There is a clamp member adjustably mounted on the spout waterway to be positioned against and on top of the supporting surface sink deck. A spout fastener extends through an opening in the clamp member and is held in position therein by a portion of the spout waterway. The spout fastener adjustably cooperates with a threaded bore on the spout to removably fasten the spout against and on top of the supporting surface.

21 Claims, 2 Drawing Sheets

MODULAR LAVATORY FAUCET SPOUT MOUNTING

THE FIELD OF THE INVENTION

The present invention relates to what is termed "modular" lavatory faucet spouts and in particular to a faucet spout fixture in which the spout may be removed from above the sink deck without affecting the waterway connections beneath the sink deck. This permits the decorative portion of the plumbing fixture—the spout—which also has a functional purpose, to be removed and replaced without affecting the plumbing connections. Such is particularly advantageous for consumers who are remodeling and wish to change a plumbing fixture, and to builders who are selling upgraded fixtures in new construction and wish to avoid the necessity of buying an entirely new plumbing fixture and the consequent installation expense.

With the present invention the spout or any similar water control plumbing fixture may have the exposed decorative and/or functional element thereof removed and replaced, with a similar element having a different appearance, but with the same function, without in any way requiring the underlying waterways to be disconnected. Although the invention will be described more particularly in connection with a lavatory faucet spout, it is equally applicable to any other water control plumbing fixture, or combination of a group or suite of such fixtures having a common decorative theme, in which there is a functional and decorative element on one side of a supporting, normally visible surface and the waterway connections are on the opposite or normally non-visible side of the supporting surface.

SUMMARY OF THE INVENTION

The present invention relates to modular plumbing fixtures and in particular to a faucet spout fixture in which the spout may be removed from the exposed side of the sink deck without affecting the underlying waterway connections.

A primary purpose of the invention is to provide a modular plumbing fixture for water control in which the decorative and exposed portion may be easily removed and replaced without affecting the underlying waterway connections.

Another purpose is to provide an improved, reliable and simplified mounting for a faucet spout in which all of the exposed elements of the spout may be removed from only the top side of the sink deck.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
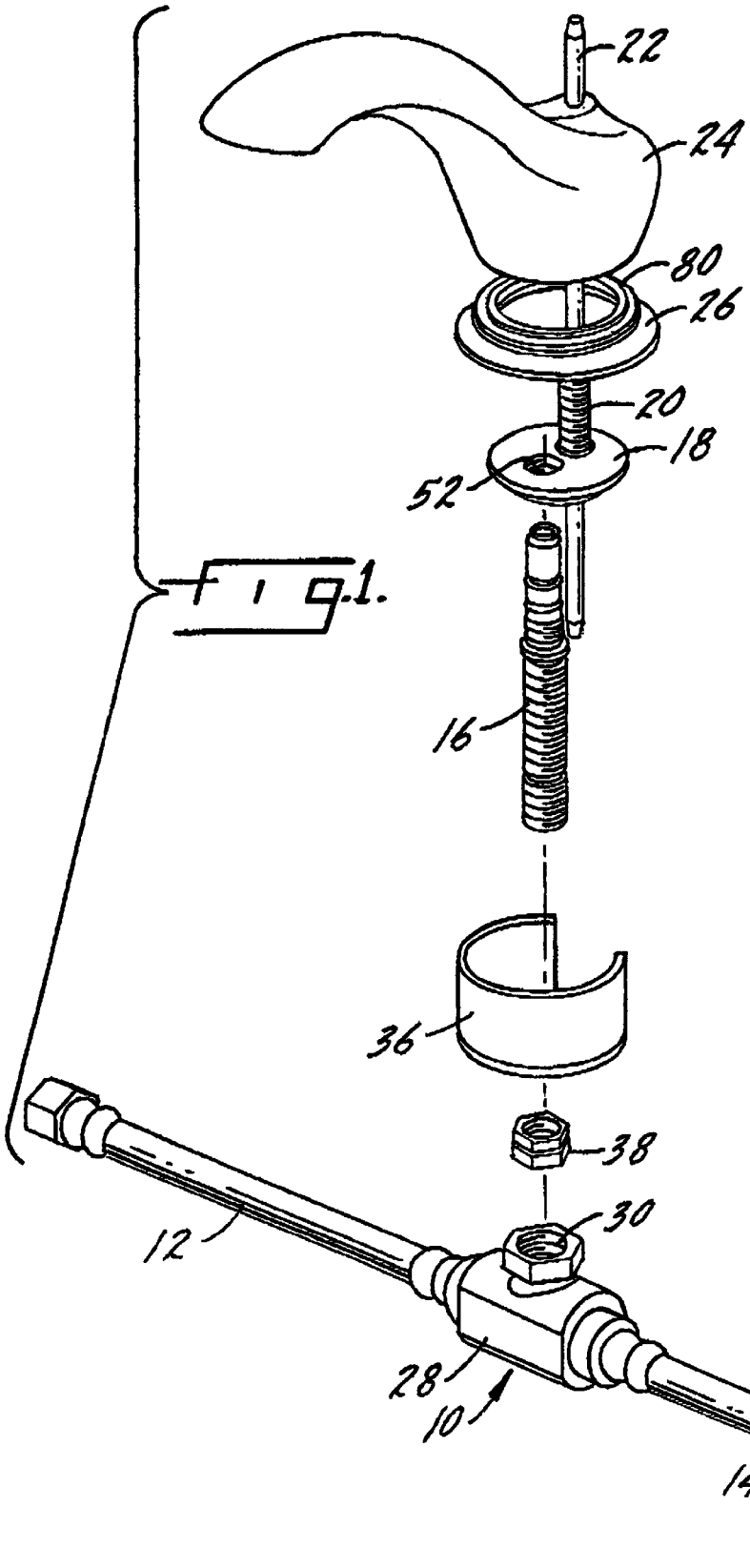
FIG. 1 is an exploded perspective of the plumbing fixture of the present invention.

FIG. 1 illustrates the principal components of the faucet spout fixture. The fixture shown is a lavatory spout, although the invention is equally applicable to other types of water control plumbing fixtures which are mounted on a supporting surface such as a sink deck or wall.

The hose assembly is indicated at 10 and will have a hot water conduit 12 and a cold water conduit 14. There is a spout waterway 16 which will be connected, as described, to the hose assembly 10. A clamp member 18 threadedly mounts the spout waterway 16 and a fastener 20 will be held in the clamp member 18 by the spout waterway 16 and provides both a support for the lift rod 22 and the means for mounting the spout 24 and the escutcheon 26 to the sink deck.

Figure 2:
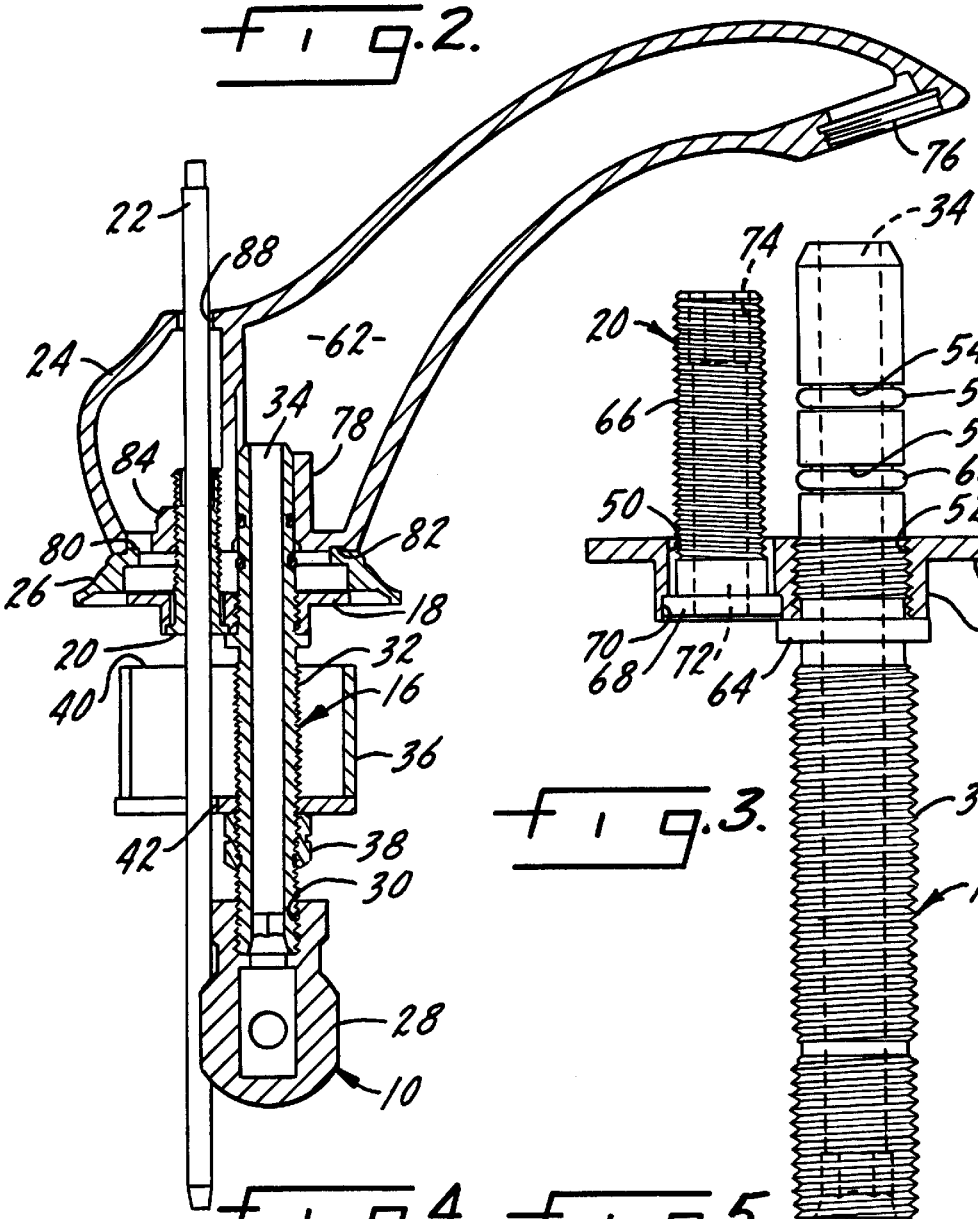
FIG. 2 is an axial section through the plumbing fixture.

As illustrated in FIG. 2, the hose assembly 10 has a central connector 28 with an upwardly-facing threaded bore 30. The spout waterway 16 which is exteriorly threaded, as at 32, will be threadedly mounted in the bore 30 and has an internal water passage 34 to direct water from the hose assembly 10 up to the spout 24. There is a partially cylindrical mounting washer 36 which is held in position on the waterway 16 by a mounting nut 38, with the top surface 40 of the mounting washer normally abutting the underside of the sink deck. The mounting washer 36 has an opening 42 for passage of the lift rod 22.

The clamp plate 18 has a plate portion 44, the lower surface 46 of which will normally be seated on the top of the sink deck. There is a cylindrical boss 48 which will extend downwardly through an opening in the sink deck and has a first opening 50 for the threaded fastener 20 and a second threaded opening 52 for threaded attachment of the spout waterway 16. This is particularly shown in FIG. 3. The spout waterway 16 has spaced grooves 54 and 56, each of which contains seal rings 58 and 60, respectively. The upper end of the spout waterway 16 extends into an interior water passage 62 of the spout 24, as shown in FIG. 2.

Figure 3:
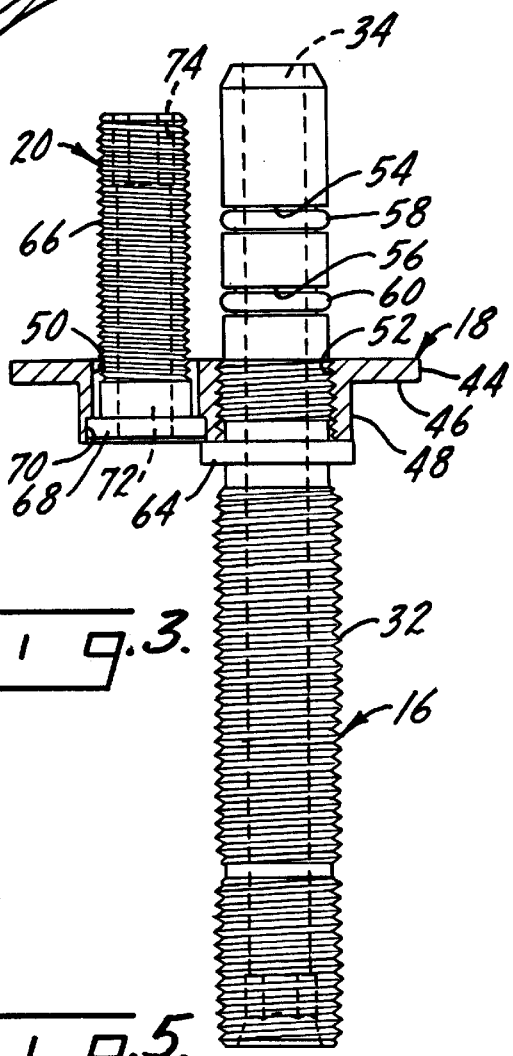
FIG. 3 is an enlarged, in part section, of the clamping portion of the plumbing fixture.
Figure 4:
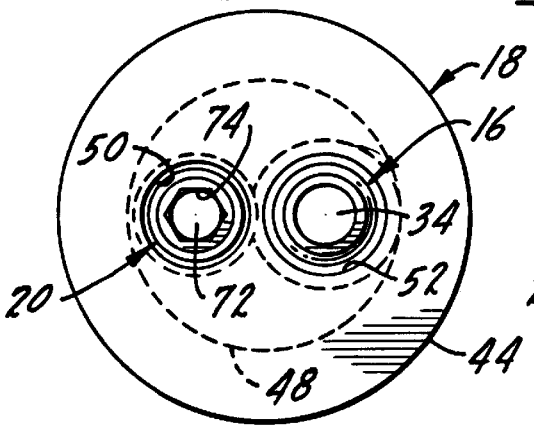
FIG. 4 is a top view of the clamp plate, spout waterway and spout screw.
Figure 5:
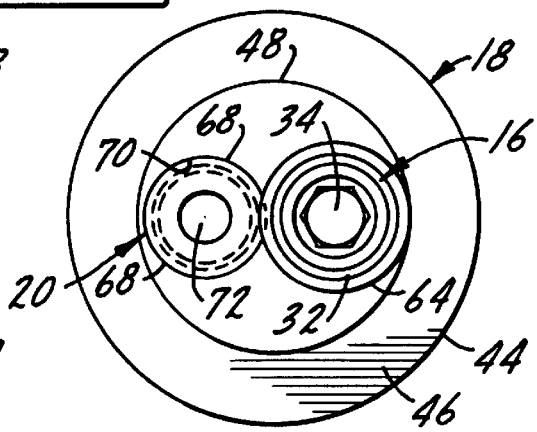
FIG. 5 is a bottom view of the clamp plate, spout waterway and spout screw.

The spout waterway 16 has an outwardly extending annular shoulder 64 which will normally abut the underside of the boss 48, as shown in FIG. 3, when the waterway is mounted to the clamp plate 18. The spout fastener 20, which is threaded, as at 66, throughout substantially its entire length, has a head or flange 68 at its bottom side, which flange cooperates with the shoulder 64 on the spout waterway 16 to hold the fastener in position in the clamp plate. This is shown in FIG. 3. There is a small recess 70 at the bottom end of the opening 50 to accept the flange 68 of the fastener 20 so that the fastener may be somewhat loosely held in position, but there is no permitted degree of axial movement of the fastener once it is held in the clamp plate by the spout waterway.

Figure 6:
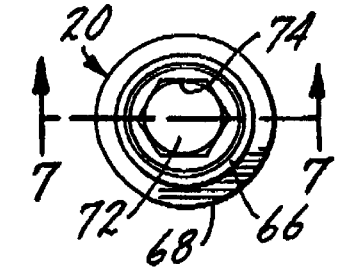
FIG. 6 is an enlarged top view of the spout screw.
Figure 7:
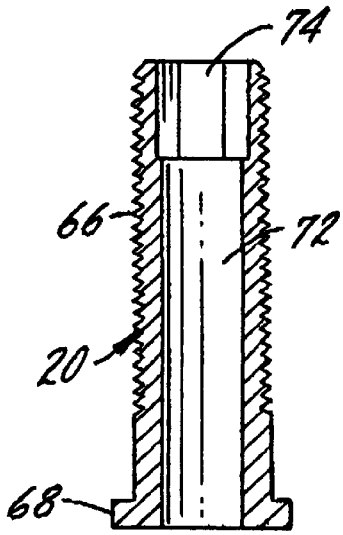
FIG. 7 is a section along plane 7—7 of FIG. 6.
Figure 8:
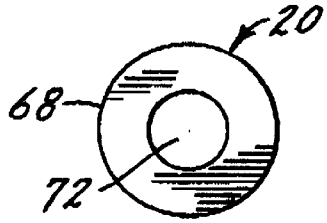
FIG. 8 is a bottom view of the spout screw.

The fastener is shown more particularly in FIGS. 6, 7 and 8 and has an internal bore 72 for passage of the lift rod 22 and has a tool receiving hex-shaped opening 74 at the upper end thereof. The tool receiving opening will be used, as described hereinafter, to attach and remove the spout to the clamp plate and thus to the sink deck.

The spout 24 has a discharge opening 76 which communicates with the passage 62 and the passage 62 is in communication with the upper end of the spout waterway 16. The spout 24 has a smooth cylindrical boss 78 which functions as the water inlet and the spout waterway extends into this boss with the seal rings bearing against its interior wall. The spout 24 is seated upon the escutcheon 26 and the escutcheon may have an upwardly raised bead 80 which extends within a groove 82 in the bottom of the spout interlocking these two elements. There is a threaded boss 84 in the spout, as particularly shown in FIG. 2, which will receive the threaded spout fastener 20. This is the means for attaching the spout to the fastener which is in turn attached to the clamp plate by the spout waterway.

To assemble the faucet spout fixture, first the hose assembly will be attached to the underside of a sink deck by use of the spout waterway and the clamp plate 18. The waterway will be threadedly attached, with the mounting washer 36 and the mounting nut 38, to the underside of the sink deck, with the clamp plate 18 on the top side of the sink deck. The hose assembly may be connected to the hot and cold water supplies or to the valves which control such supplies, either before or after the spout is mounted to the sink deck.

Before the clamp plate is secured to the spout waterway, the fastener 20 will first be located in the opening 50 as shown in FIG. 3. Thus, when the clamp plate and the spout waterway are permanently attached, the fastener will be held in the clamp plate by the cooperating flange and shoulder 68 and 64 to the end that the fastener will extend upwardly and is in position to receive the spout. Next, the escutcheon 26 will be positioned so that it extends over the clamp plate, as shown in FIG. 2. Both the underside of the clamp plate and the escutcheon will bear against the top of the sink deck. The spout is then positioned over both the spout waterway and the fastener, as shown in FIG. 2. The spout waterway extends into the boss 78 so as to provide a water connection for the spout discharge 76. At this point the lift rod 22 is not positioned within the spout, but instead, a tool with a hex-shaped end, for example an allen wrench, will extend down through the opening 88 in the top of the spout and will turn the fastener 20 which is threaded into the boss 84. As the fastener is turned by the allen wrench, the spout 24 will be snugged down upon the escutcheon which will be held by the spout onto the top of the sink deck. Once this assembly is complete, the allen wrench is removed and the lift rod is inserted to perform its normal function.

To remove the spout, without affecting the underlying water connections, the lift rod will be pulled upwardly, out of the spout, and an allen wrench will be inserted in the tool receiving opening 74 of the fastener 20. The allen wrench will be turned to loosen the connection between the fastener and the spout. This will permit the spout to be removed. Thus, the spout may be replaced with one of different configuration and/or finish without affecting the underlying water connections. This is particularly advantageous when one is remodeling a bathroom or when a contractor wishes to do an upgrade or change the faucet exterior appearance without purchasing and installing an entirely new plumbing fixture.

Although the present invention is described in connection with a "modular" lavatory faucet spout, the invention has a broader context. It is often the situation that if a portion of a plumbing fixture which has both decorative and functional purposes is to be removed and replaced with one having the same functional purpose, but a different decorative purpose, that all of the fixtures in a lavatory or bathroom will be similarly modified so that all of the fixtures within the bath suite will have a common decorative theme. Thus, each of the plumbing fixtures, and this could include the faucet, a shower assembly, a tub spout, a bidet, as well as other water control plumbing products, will have a decorative portion of such plumbing fixture, which decorative portion also has a functional purpose, replaced or modified at the same time. Thus, the "modular" concept applies not just to a single fixture, but to all fixtures within a bath suite. U.S. patent application Ser. No. 09/422,773, filed on Oct. 22, 1999 and assigned to Moen Incorporated, assignee of the present application, discloses a modular shower arm assembly, and the disclosure of such application is herein incorporated by reference.

Whereas the preferred form of the invention has been shown and described herein, it should be realized that there may be many modifications, substitutions and alterations thereto.

The embodiments of the invention in which an exclusive property or privilege is claimed are defined as follows:

1. A faucet spout fixture which provides for spout mounting and removal from above a supporting surface and without disconnection of water supply conduits, said fixture including a faucet spout having a water passage and a water discharge in communication therewith, a water inlet in said spout in communication with said passage, mounting means on said spout, a water supply assembly for location beneath the supporting surface, a spout waterway adjustably connected to said water supply assembly beneath the supporting surface, said spout waterway extending through an opening in the supporting surface and extending into said spout water inlet, a clamp member adjustably mounted on said spout waterway for positioning against and on top of the supporting surface, a spout fastener extending through an opening in said clamp member and means for holding said spout fastener in position therein, said spout fastener adjustably cooperating with the spout mounting means to removably fasten the spout against and on top of the supporting surface.

2. The faucet spout fixture of claim 1 wherein said spout waterway is threadedly attached to said clamp member.

3. The faucet mounting fixture of claim 2 wherein said fastener is threadedly attached to said spout mounting means.

4. The faucet mounting fixture of claim 3 wherein said spout mounting means is a threaded bore in said spout.

5. The faucet mounting fixture of claim 1 wherein said spout includes a body and an escutcheon, said spout escutcheon extending about said clamp member, said spout body being seated upon said escutcheon.

6. The faucet spout fixture of claim 1 wherein said spout fastener has an outward projection, said spout waterway has an outward projection underlying said spout fastener projection and functioning to hold said spout fastener in said clamp member.

7. The faucet spout fixture of claim 6 wherein said clamp has a top plate and a downwardly extending boss, said boss having a pair of openings, one for said spout fastener and the other for said spout waterway.

8. The faucet mounting fixture of claim 7 wherein the opening in said boss for said spout waterway has a threaded interior wall.

9. The faucet spout fixture of claim 7 wherein said spout fastener opening in said clamp plate is smooth.

10. The faucet mounting fixture of claim 6 wherein said fastener outward projection is an annular flange.

11. The faucet spout fixture of claim 10 wherein said waterway outward projection is an annular shoulder.

12. The faucet spout fixture of claim 1 wherein said spout has an opening in axial alignment with said spout fastener, said spout fastener having a tool receiving cavity facing said spout opening.

13. The faucet spout fixture of claim 12 further including a lift rod, normally extending through said spout opening and through said spout fastener.

14. The faucet spout fixture of claim 1 further including a mounting washer positioned beneath the supporting surface and in contact therewith, said mounting washer being held in position by a nut threaded on said spout waterway.

15. The faucet spout fixture of claim 1 wherein said spout waterway has at least one annular groove, and a seal ring in said groove, said seal ring being in sealing contact with said spout inlet.

16. The faucet spout fixture of claim 1 wherein the means for holding said spout fastener in position in said clamp member includes a portion of said spout waterway.

17. A water control plumbing fixture for mounting on a support, which support has a normally visible surface and a normally non-visible surface, and wherein the fixture has water supply connections on the normally non-visible surface and has a functional and decorative element on the normally visible surface, and wherein the functional and decorative element may be removed and replaced from the fixture from the visible surface without affecting the water supply connections on the normally non-visible surface, said fixture including a waterway adjustably attached to the water supply connections, said waterway extending into said functional and decorative element to supply water thereto, and clamping means adjustably mounted on the waterway on the visible surface, said clamping means including means for attaching and removing said decorative and functional element from only the visible surface of the support.

18. The water control plumbing fixture of claim 17 wherein said functional and decorative element is a faucet spout.

19. The water control plumbing fixture of claim 17 wherein said clamping means includes a clamp plate adjustably mounted on the waterway, a fastener extending through said clamp plate and adjustably mounted to said functional and decorative element.

20. The water control plumbing fixture of claim 19 wherein said waterway retains said fastener in position in said clamp plate.

21. The water control plumbing fixture of claim 20 wherein said fastener is threadedly engaged with said functional and decorative element.

* * * * *